US005528796A

United States Patent [19]

Perry et al.

[11] Patent Number: 5,528,796

[45] Date of Patent: Jun. 25, 1996

[54] HINGED CONNECTION FOR A TILT UP DEVICE

[75] Inventors: John M. Perry, Clinton; Edward P. Evers, Basking Ridge, both of N.J.

[73] Assignee: Proformix, Inc., Branchburg, N.J.

[21] Appl. No.: 471,569

[22] Filed: Jun. 6, 1995

[51] Int. Cl.[6] ..... E05D 11/08; E05D 1/04; A47F 7/14

[52] U.S. Cl. ..... 16/355; 16/342; 16/337; 16/334; 248/918; 108/137; 108/143

[58] Field of Search ..... 16/355, 342, 337, 16/334, 319; 248/918, 298.1; 108/137, 143

[56] References Cited

U.S. PATENT DOCUMENTS

| | | | |
|---|---|---|---|
| 746,398 | 12/1903 | Soss | 16/355 |
| 3,027,592 | 4/1962 | Schnur | 16/355 |
| 4,379,360 | 4/1983 | Papsdorf | 16/337 |
| 4,573,240 | 5/1986 | Labelle | 16/355 |
| 4,648,574 | 3/1987 | Granlund | 248/918 |
| 4,779,922 | 10/1988 | Cooper | 248/918 |
| 5,118,172 | 8/1992 | Ugalde | 108/137 |
| 5,294,087 | 3/1994 | Drabczyk et al. | 108/143 |
| 5,351,897 | 10/1994 | Martin . | |

*Primary Examiner*—Maurina T. Rachuba
*Assistant Examiner*—Adesh Bhargava
*Attorney, Agent, or Firm*—Lerner, David, Littenberg, Krumholz & Mentlik

[57] ABSTRACT

A hinge assembly removably connects two bodies for pivotable movement relative to one another. The hinge assembly includes a first convex arcuate surface and a first concave arcuate surface on one body and a second convex arcuate surface and a second concave arcuate surface on the other body. The radii of curvature of the first convex arcuate surface and the second concave arcuate surface are about equal, and the radii of curvature of the second convex arcuate surface and the first concave arcuate surface are about equal, and each surface preferably defines an arc of about 180 degrees. The bodies may be assembled to one another so that the first convex arcuate surface slidingly engages the second concave arcuate surface and the first concave arcuate surface slidingly engages the second convex arcuate surface, thereby preventing relative movement of the bodies in a direction transverse to the pivot axis. The hinge assembly also includes an arrangement for preventing the movement of the bodies relative to one another along the pivot axis. The hinge assembly is particularly useful for releasably joining the components of a retractable document holder which may be slideably mounted below a work surface either independently or in combination with a keyboard support assembly.

34 Claims, 10 Drawing Sheets

HINGED CONNECTION FOR A TILT UP DEVICE

FIELD OF THE INVENTION

The present invention relates generally to hinges, and more particularly to a hinge assembly for removably connecting one member to another for relative pivotable movement therebetween. Still more particularly, the invention relates to the use of the hinge in a work unit which can be mounted beneath a work station and which includes a work surface which can be pivoted between a storage position and a use position.

BACKGROUND OF THE INVENTION

The advent of the personal computer has led to dramatic changes in the office environment, and particularly in the local work stations of individual employees. In that regard, the prevalence of personal computers has placed a premium on work surface space. Consequently, various mounting hardware has been developed which enables keyboards and ancillary devices to be conveniently stored below the work surface when not in use, yet easily pulled out from beneath the work surface when needed. Hence, these mounting systems maximize the work surface space available to the user.

One such device which has heretofore been available is a metallic slide out document holder sold by Proformix, Inc., the assignee of the present application, under model number PR-0210ICH. This document holder consists of a substantially fiat top metal plate which is pivotally mounted to a substantially fiat bottom metal plate by a pair of tabs which project laterally outward from one end of the top plate and which are received within a pair of holes at one end of the upwardly bent longitudinal side edges of the bottom plate. A pair of document support arms are pivotally connected to the top plate and can be extended therefrom to increase the support surface of the document holder. The document holder may be mounted to the underside of a work surface by a pair of spaced apart guide rails having channels in which the side edges of the bottom plate can slide. The end of the bottom plate adjacent the hinged connection is also bent upwardly to provide a grasping surface for moving the document holder under and out from the work surface.

There have been several drawbacks to the slide out document holder described above. One of these drawbacks has been the fact that its metal construction has caused the document holder to be heavy and to not operate smoothly with plastic molded guide rails. Another drawback has been the lack of versatility of the document holder. That is, because the top and bottom plates are fixedly connected together, the top plate cannot be removed from the bottom plate and replaced with a device which serves a different purpose than the document holder without bending and damaging the bottom plate in the process.

There therefore exists a need for a slide-out unit incorporating a document holder in which the document holder can be easily removed and replaced with a different device, such as a marking board, a message board, etc. Preferably, such slide-out unit will have a simple construction such that it can be manufactured easily and inexpensively from plastic materials.

SUMMARY OF THE INVENTION

The present invention addresses these needs.

One aspect of the present invention provides a hinge assembly for removably connecting a first unit to a second unit in an assembled position for pivotable movement about a pivot axis extending in an axial direction. The hinge assembly includes a first hinge element on the first unit, the first hinge element including a first convex arcuate surface having a first radius of curvature and a first concave arcuate surface having a second radius of curvature and a free end. The hinge assembly also includes a second hinge element on the second unit, the second hinge element including a second convex arcuate surface having a radius of curvature substantially equal to the second radius of curvature, and a second concave arcuate surface having a radius of curvature substantially equal to the first radius of curvature. The first convex arcuate surface may be spaced in the axial direction from the first concave arcuate surface and the second convex arcuate surface may be spaced in the axial direction from the second concave arcuate surface. In preferred embodiments hereof, the second radius of curvature may be substantially equal to the first radius of curvature. In more preferred embodiments, each one of the arcuate surfaces may define an arc of about 180 degrees. In this last embodiment, the first convex arcuate surface may be positioned on one side of the pivot axis and the first concave arcuate surface may be positioned on the same side of the pivot axis. In the assembled position of the first and second units, the first convex arcuate surface matingly engages the second concave arcuate surface and the first concave arcuate surface matingly engages the second convex arcuate surface to prevent movement of the first unit relative to the second unit in a direction transverse to the axial direction.

The hinge assembly further includes locating means for preventing movement of the first unit relative to the second unit in the axial direction. In one embodiment, the locating means may include a first locating surface positioned on the first hinge element radially outward of the first convex arcuate surface, a second locating surface positioned on the first hinge element radially inward of the first concave arcuate surface, a third locating surface positioned on the second hinge element radially outward of the second convex arcuate surface, and a fourth locating surface positioned on the second hinge element radially inward of the second concave arcuate surface. In the assembled position of the first and second units, the first locating surface may engage the third locating surface and the second locating surface may engage the fourth locating surface to prevent movement of the first unit relative to the second unit in the axial direction.

In another embodiment, the locating means may include first and second locating surfaces positioned on the first hinge element radially outward of the first convex arcuate surface, and third and fourth locating surfaces positioned on the second hinge element radially outward of the second convex arcuate surface. In the assembled position of the first and second units, the first locating surface may engage the third locating surface and the second locating surface may engage the fourth locating surface to prevent movement of the first unit relative to the second unit in the axial direction.

Preferably, the first and second hinge elements in the assembled position define a hollow channel extending in the axial direction. More preferably, in embodiments in which the first unit is pivotably movable relative to the second unit between a collapsed condition in which the first unit is adjacent to the second unit and a use position in which the first unit is remote from the second unit, the hollow channel in the collapsed condition defines a semicircular trough.

In another embodiment in accordance with this aspect of the present invention, the hinge assembly may include a first pair of hinge elements on the first unit separated by a spaced distance in the axial direction. One of the first pair of hinge elements may include a first convex arcuate surface having a first radius of curvature and a first concave arcuate surface having a second radius of curvature and a free end. The other one of the first pair of hinge elements may include a second convex arcuate surface having a third radius of curvature and a second concave arcuate surface having a fourth radius of curvature and a free end. The hinge assembly may also include a second pair of hinge elements on the second unit separated by the same spaced distance in the axial direction. One of the second pair of hinge elements may include a third convex arcuate surface having a radius of curvature substantially equal to the second radius of curvature and a third concave arcuate surface having a radius of curvature substantially equal to the first radius of curvature. The other one of the second pair of hinge elements may include a fourth convex arcuate surface having a radius of curvature substantially equal to the fourth radius of curvature and a fourth concave arcuate surface having a radius of curvature substantially equal to the third radius of curvature. Preferably, the first, second, third and fourth radii of curvature are substantially equal to one another. In the assembled position of the first and second units, the first convex arcuate surface matingly engages the third concave arcuate surface, the second convex arcuate surface matingly engages the fourth concave arcuate surface, the first concave arcuate surface matingly engages the third convex arcuate surface and the second concave arcuate surface matingly engages the fourth convex arcuate surface to prevent movement of the first unit relative to the second unit in a direction transverse to the axial direction.

The hinge assembly in accordance with this embodiment of the present invention also includes locating means for preventing movement of the first unit relative to the second unit in the axial direction. In one embodiment, the locating means may include a first locating surface positioned on one of the first pair of hinge elements radially outward of the first convex arcuate surface, a second locating surface positioned on the one of the first pair of hinge elements radially inward of the first concave arcuate surface, a third locating surface positioned on one of the second pair of hinge elements radially outward of the third convex arcuate surface, and a fourth locating surface positioned on the one of the second pair of hinge elements radially inward of the third concave arcuate surface. In the assembled position of the first and second units, the first locating surface may engage the third locating surface and the second locating surface may engage the fourth locating surface to prevent movement of the first unit relative to the second unit in the axial direction.

In another embodiment, the locating means may include first and second locating surfaces positioned on one of the first pair of hinge elements radially outward of the first convex arcuate surface, and third and fourth locating surfaces positioned on one of the second pair of hinge elements radially outward of the second convex arcuate surface. In the assembled position of the first and second units, the first locating surface may engage the third locating surface and the second locating surface may engage the fourth locating surface to prevent movement of the first unit relative to the second unit in the axial direction.

Another aspect of the present invention provides a retractable work apparatus adapted to be mounted to the underside of a work surface. The work apparatus may include a base member and means for connecting the base member to the underside of the work surface. A sled member is connected to the base member for movement between a retracted position in which the sled member lies substantially below the work surface and an extended position in which the sled member protrudes substantially from below the work surface, and a work unit is removably connectable to the sled member in an assembled position. Positioning means may be provided on the sled member for releasably locking the sled member in one of a number of preselected positions relative to the base member. The work apparatus further includes a hinge assembly as described above for removably connecting the work unit to the sled member for pivotable movement about a pivot axis extending in an axial direction. The hinge assembly enables the work unit to be removed from sled member and replaced with a work unit which performs a different function.

The work unit may take many forms. In one embodiment, the work unit may comprise a document holder consisting of a panel having a pair of longitudinal side edges extending in a direction transverse to the axial direction, and at least one arm pivotably connected to the panel for movement between a storage position in which the arm resides between the side edges of the panel and a use position in which the arm projects outwardly from one of the side edges of the panel.

In another embodiment, the work unit may comprise a note board consisting of a panel having a generally flat front surface facing away from the sled member, with the front surface including a waterless marker surface or a chalkboard surface. In other embodiments, the work unit may be a message board which includes a panel having a front surface printed with messages.

In preferred embodiments of the work apparatus, the base member may include a pair of spaced support surfaces, the sled member being slideably assembled to the base member for movement on the pair of spaced support surfaces between the retracted and expanded positions.

In a highly preferred embodiment of the present invention, the work apparatus may further include a keyboard support tray. In accordance with this embodiment, the base member may include another pair of spaced support surfaces and the keyboard support tray may be slideably mounted to the base member for movement on the another pair of spaced support surfaces between a retracted position in which the keyboard support tray lies substantially below the work surface and an extended position in which the keyboard support tray extends substantially from below the work surface.

As noted above, the hinge assembly of the present invention is advantageously used in connection with a work apparatus mounted to the underside of a work surface and movable between a retracted storage position and an extended use position. Thus, the hinge assembly permits the work apparatus to be readily manufactured by simple injection molding techniques without the need for complex mold inserts. Furthermore, the hinge assembly enables the work apparatus to be easily converted from one function to another. By simply removing one work unit from the sled member and replacing it with a different work unit, the work apparatus can be converted from a document holder to a note board, message board, calculator support or a variety of other devices which will accommodate the needs of a worker at a work station. In addition to these primary functions, the work apparatus of the present invention may simultaneously serve a variety of other functions, including the storage of pencils, pens and other writing implements and the storage of flat articles such as papers, cards, floppy disks and the like.

The hinge assembly of the present invention may also find application in a variety of other devices. In general, such uses include the assembly of removable covers or removable doors onto a variety of apparatus which are not necessarily limited to the computer field.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
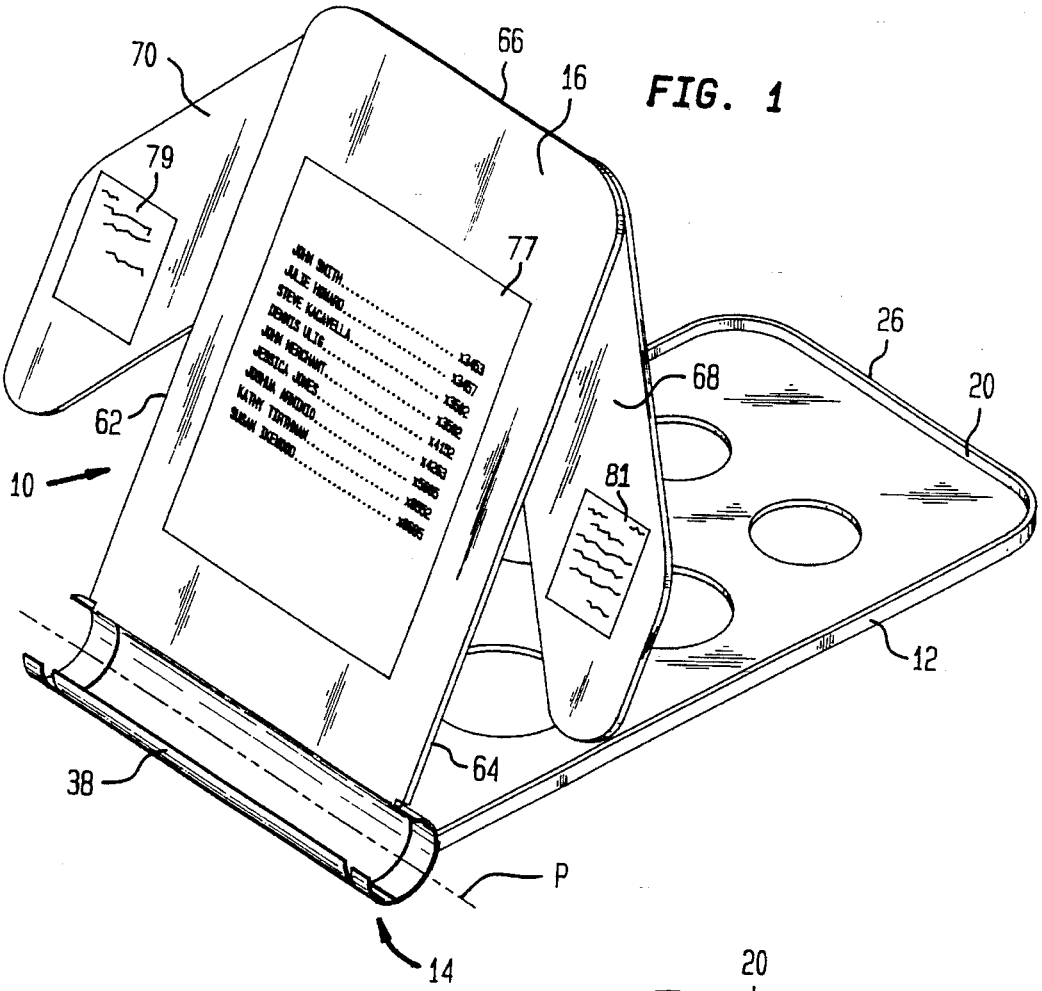
FIG. 1 is a perspective view showing the document holder of the present invention in a use position.
Figure 2:
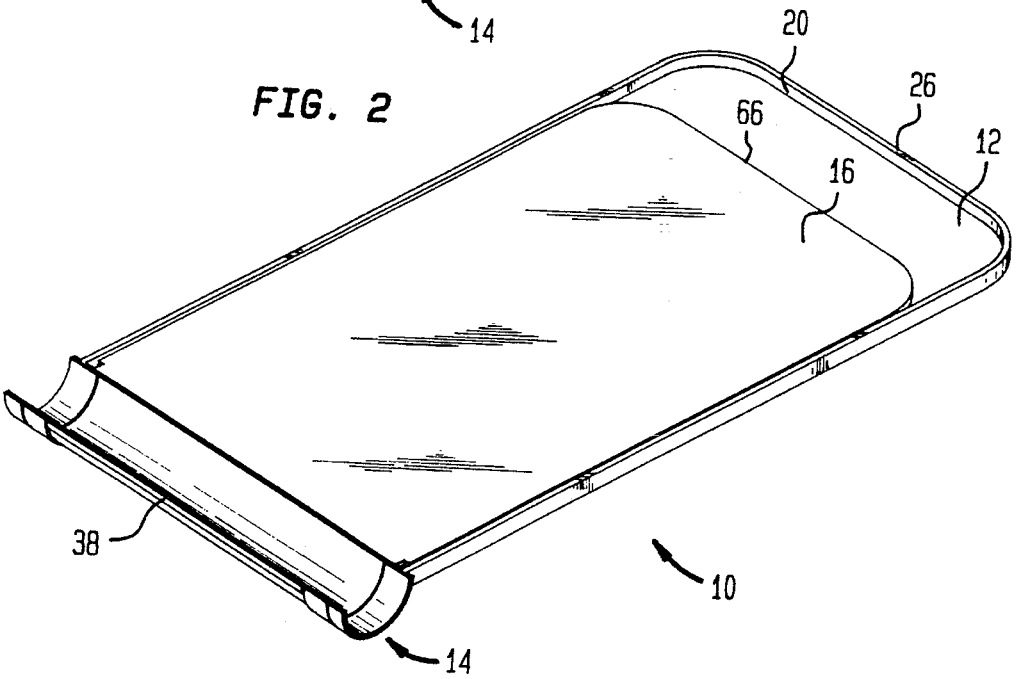
FIG. 2 is a perspective view of the document holder of FIG. 1 in the storage position.
Figure 3:
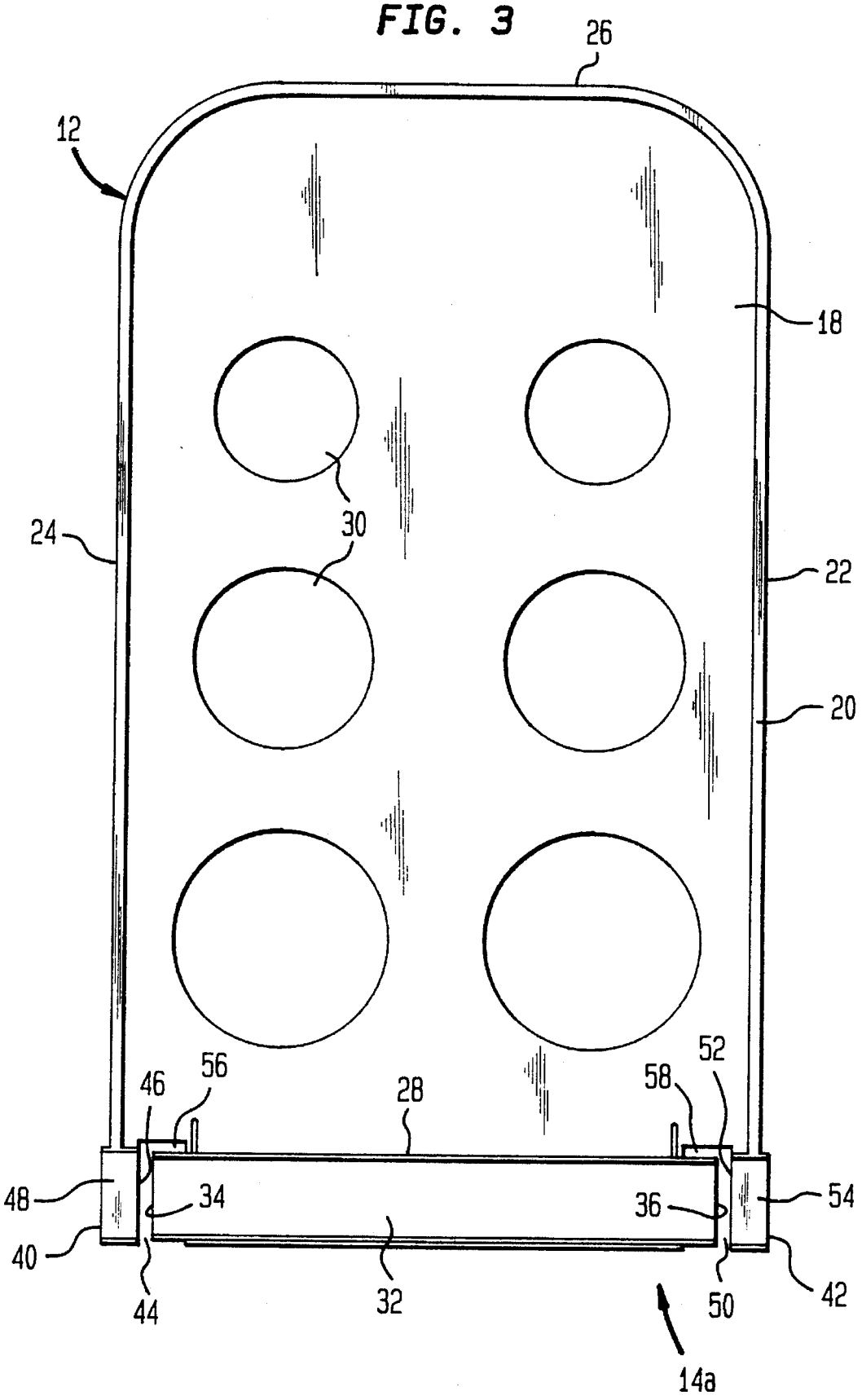
FIG. 3 is a top plan view of the sled member of the document holder shown in FIG. 1.
Figure 5:
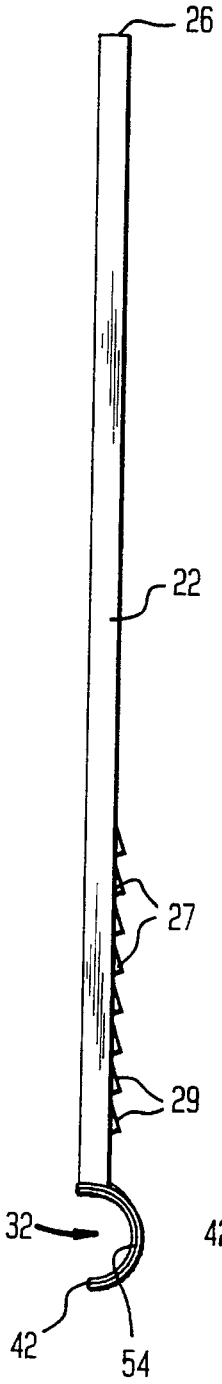
FIG. 5 is a side elevational view of the sled member shown in FIG. 3.
Figure 4:
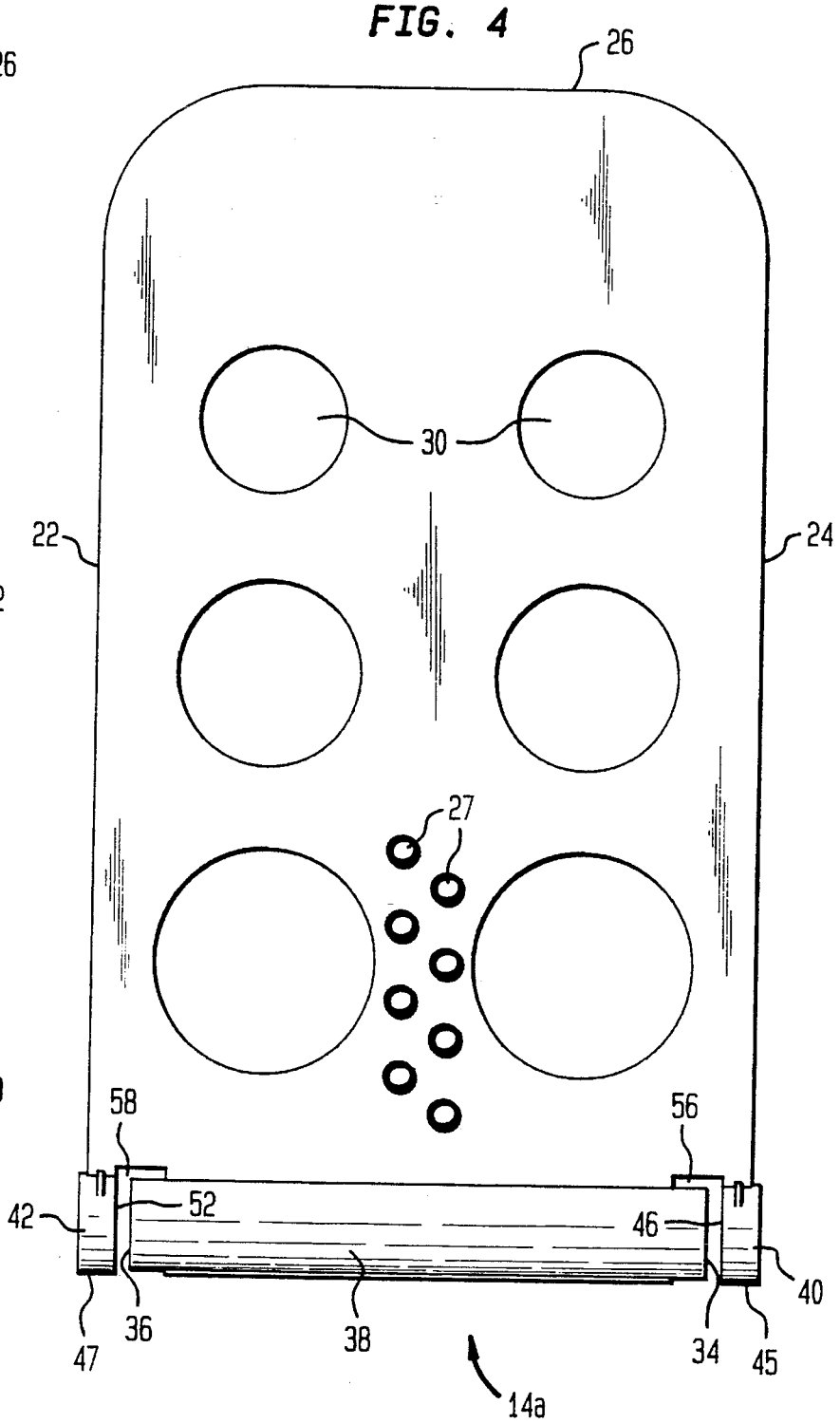
FIG. 4 is a bottom plan view of the sled member shown in FIG. 3.
Figure 6:
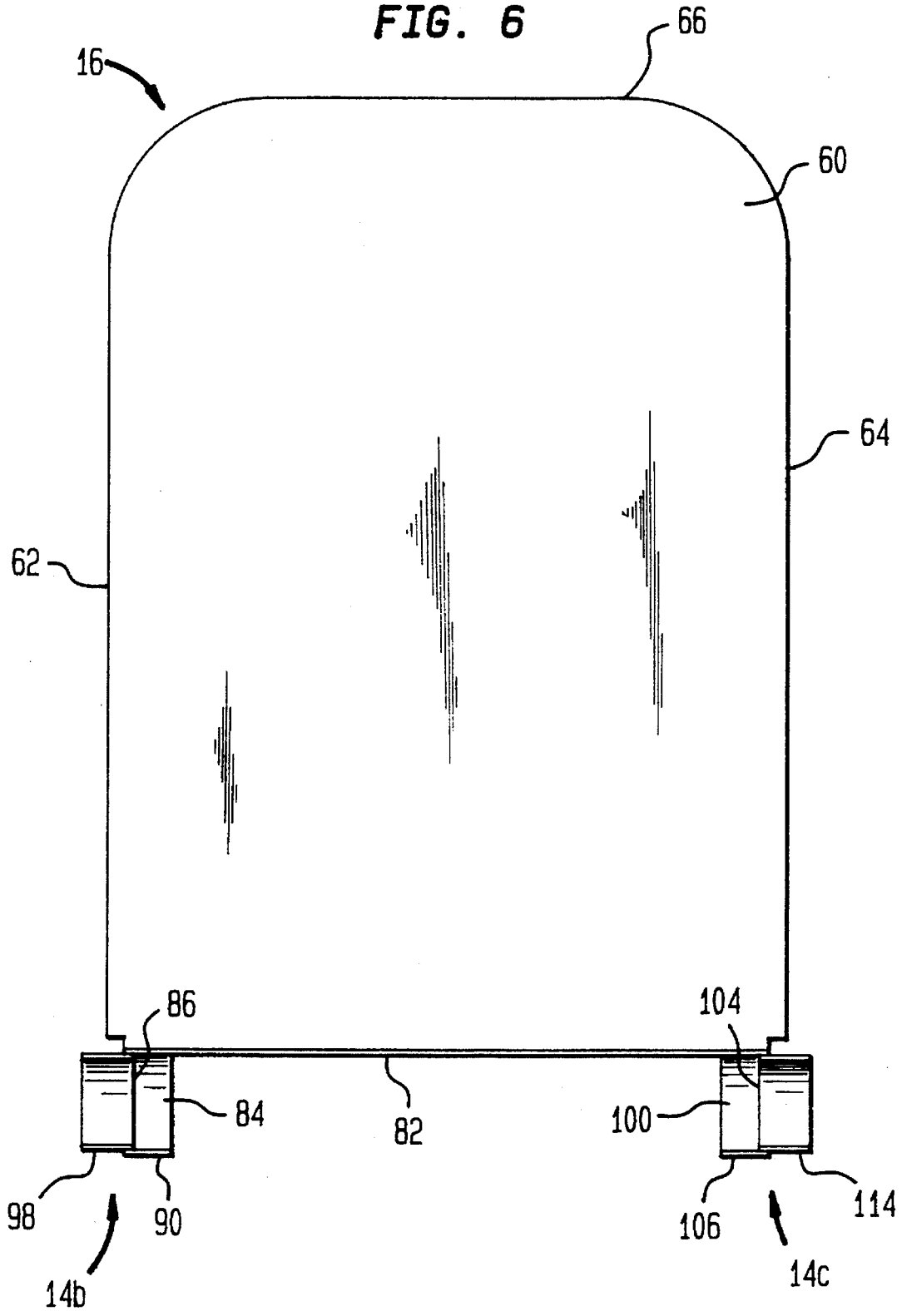
FIG. 6 is a top plan view of the document support of the document holder shown in FIG. 1.
Figures 7, 8:
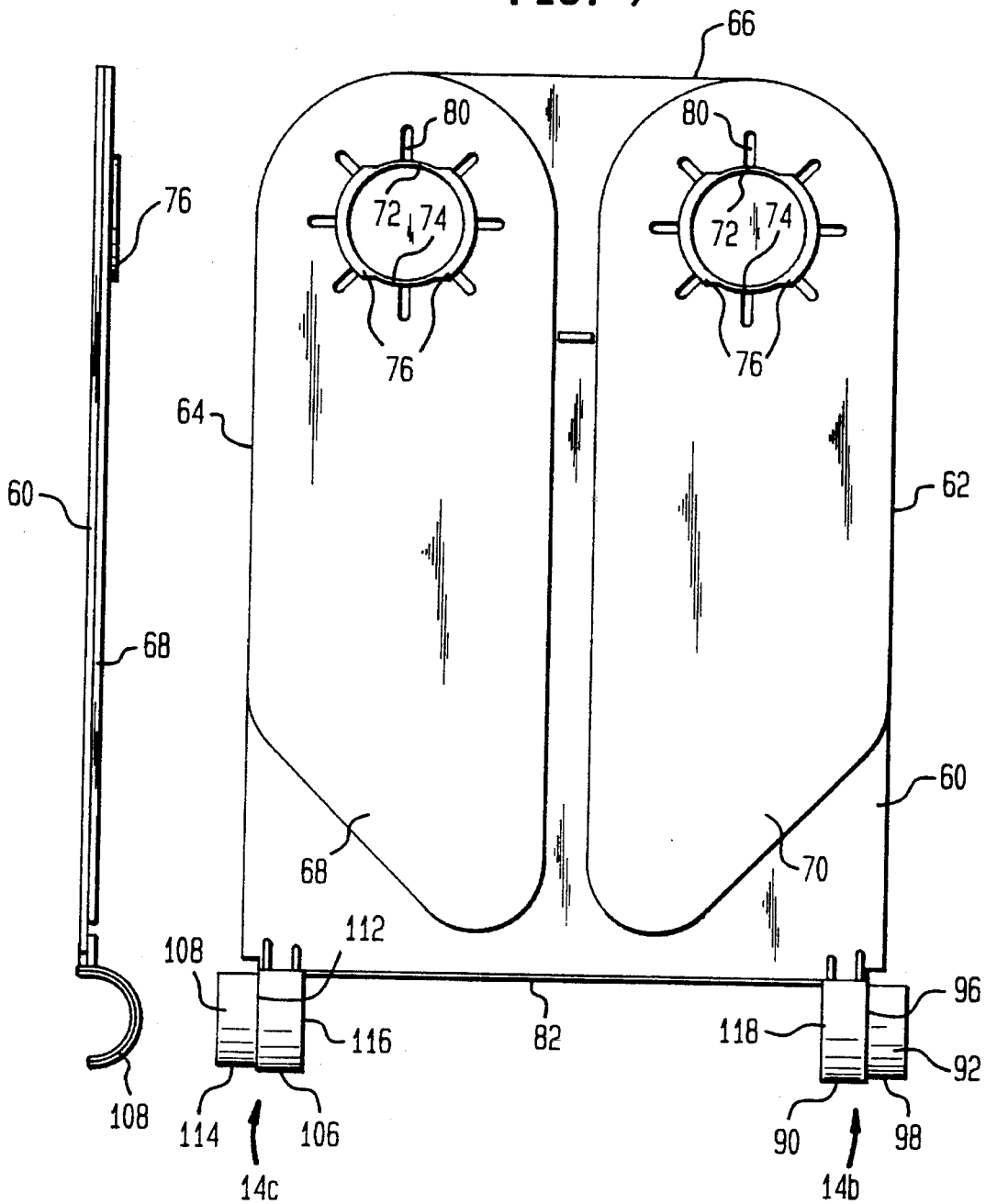
FIG. 7 is a bottom plan view of the document support shown in FIG. 6.
FIG. 8 is a side elevational view of the document support shown in FIG. 6.

Referring to the figures, FIGS. 1–7 show a document holder 10 and the components thereof in accordance with one embodiment of the present invention. Document holder 10 includes a sled member 12 which is pivotably connected through a hinge assembly 14 to a document support 16. Sled member 12 includes a generally flat elongated panel 18 having a raised lip 20 formed along the longitudinal side edges 22 and 24 and lateral rear edge 26 thereof, and one hinge portion 14*a* of hinge assembly 14 formed on the front lateral edge 28 thereof. A plurality of apertures 30 may be formed in panel 18 to reduce the mass of sled member 12 and facilitate the process for forming same. Apertures 30 may all be of the same size or may be of different sizes as illustrated in FIGS. 3 and 4. Optionally, one or more of apertures 30 may be sized to receive therein the bottom end of a paper cup for holding same in place. Panel 18 may further include on its back surface a plurality of staggered bosses 27 having free edges 29 which taper downwardly toward the rear of sled member 12. Bosses 27 enable sled member 12 to be locked into a desired position with respect to a work surface as will be explained more fully below.

Hinge portion 14*a* may be formed integrally on front edge 28 of sled member 12, and includes an elongated arcuate channel 32 which extends from one end 34 to another end 36 along a major portion of the width of sled member 12, and which defines a convex outer surface 38 having a radius of curvature $r_1$. Hinge portion 14*a* further includes a pair of arcuate fingers 40 and 42, one on each side of channel 32 and substantially coextensive with longitudinal side edges 22 and 24, respectively. Finger 40 is spaced from channel 32 by a gap 44, and includes a side edge 46 which is positioned radially outward of convex outer surface 38, a free end 45 and a concave inner surface 48. Similarly, finger 42 is spaced from channel 32 by a gap 50, and includes a side edge 52 which is positioned radially outward of convex outer surface 38, a free end 47 and a concave inner surface 54. Surfaces 48 and 54 may have the same radius of curvature $r_2$, and both are concentrically positioned with respect to the convex outer surface 38 on channel 32 such that the ends 34 and 36 of channel 32 are located radially inward of surfaces 48 and 54. As shown in the figures, $r_1$ is approximately equal to $r_2$ such that convex outer surface 38 is in substantially coextensive axial alignment with concave inner surfaces 48 and 54. A pair of notches 56 and 58 are formed in the front edge 28 of sled member 12 adjacent the ends 34 and 36 of channel 32, respectively.

Document support 16 includes a generally flat panel 60 having longitudinal side edges 62 and 64 and a lateral rear edge 66 dimensioned to fit within the raised lip 20 on sled member 12 when document holder 10 is in the fully collapsed condition shown in FIG. 2. As is also evident from FIG. 2, document support 16 is shorter in length than sled member 12 such that in the fully collapsed condition of document holder 10, the lateral rear edge 66 of document support 16 lies at a spaced distance from the lateral rear edge 26 of sled member 12. A pair of flat, generally rectangular arms 68 and 70 may be pivotably mounted to panel 60 adjacent rear edge 66 by assembling an aperture 72 on each arm over an annular ring 74 protruding from the back surface of panel 60. Flange portions 76 and 78 on ring 74 retain the arms in this assembled position. A plurality of radial slots 80 formed around the periphery of apertures 72 enable the apertures to be deformed slightly for assembly over the flange portions 76 and 78. Arms 68 and 70 preferably are sized and shaped so that, in the fully retracted position shown in FIG. 7, the arms lie entirely within the outer periphery of panel 60. For use, arms 68 and 70 may be pivoted from this fully retracted position to the position illustrated in FIG. 1, wherein the arms project outwardly from the longitudinal side edges 62 and 64 of panel 60.

Hinge portions 14*b* and 14*c* may be formed integrally on front lateral edge 82 of panel 60 substantially coextensive with longitudinal side edges 62 and 64. Hinge portion 14*b* includes a concave inner surface 84 having a locating surface 86 projecting radially inward therefrom, a free end 90, and a radius of curvature which is substantially equal to the radius of curvature $r_1$ of the convex outer surface 38 on sled member 12. Hinge portion 14*b* also includes a convex outer surface 92 which is positioned laterally outward of and in substantial concentric alignment with concave inner surface 84. Convex outer surface 92 has a locating surface 96 projecting radially outward therefrom, a free end 98, and a radius of curvature which is substantially equal to the radius of curvature $r_2$ of concave inner surface 48 of hinge portion 14*a*.

Hinge portion 14c is substantially a mirror image of hinge portion 14b. Thus, hinge portion 14c includes a concave inner surface 100 having a locating surface 104 projecting radially inward therefrom, a free end 106 and a radius of curvature which is substantially equal to radius of curvature $r_1$. Additionally, hinge portion 14c includes a convex outer surface 108 which is positioned laterally outward of and in substantial concentric alignment with concave inner surface 100. Convex outer surface 108 has a locating surface 112 projecting radially outward therefrom, a free end 114, and a radius of curvature which is substantially equal to the radius of curvature $r_2$.

Figure 9:
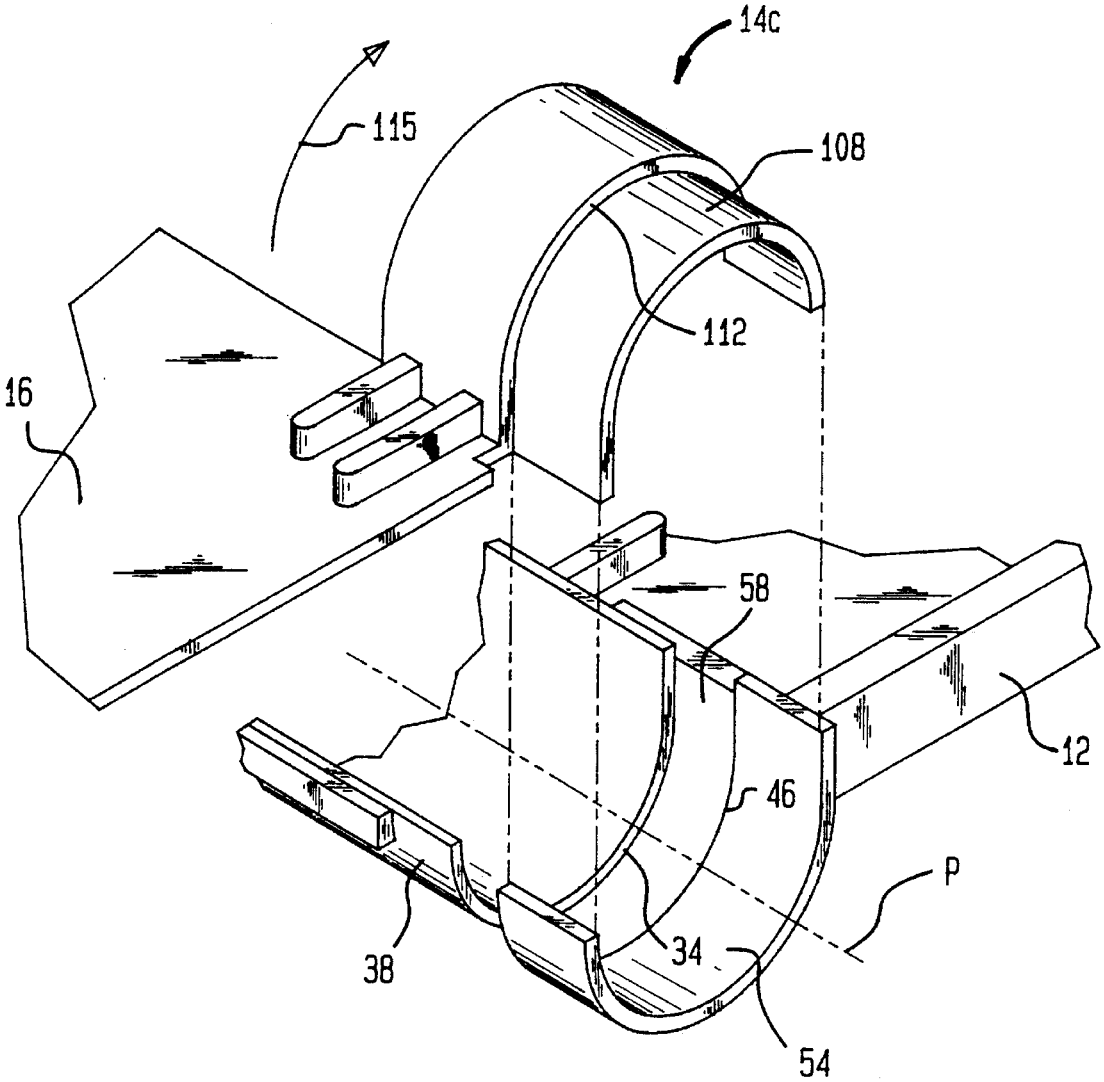
FIG. 9 is an enlarged, fragmentary view showing the attachment of the document support to the sled member.

Document support 16 may be pivotably connected to sled member 12 by engaging the concave and convex surfaces of hinge portion 14a with the concave and convex surfaces of hinge portions 14b and 14c. Thus, referring to FIG. 9, the components are arranged in end-to-end relationship with sled member 12 facing upwardly and document support 16 facing downwardly. The free end 90 of concave inner surface 84 is then inserted into notch 56 on sled member 12 and, simultaneously, the free end 106 of concave inner surface 100 is inserted into notch 58 on sled member 12. The assembly is completed by pivoting document support 16 about pivot axis P in the direction of arrow 115 toward sled member 12 whereupon hinge portions 14b and 14c will become engaged with hinge portion 14a to prevent document support 16 from moving relative to sled member 12 in directions both parallel and transverse to pivot axis P. In this assembled position, shown in FIGS. 1 and 2, convex outer surface 92 on hinge portion 14b will bear against concave inner surface 48 on hinge portion 14a, and concave inner surface 84 on hinge portion 14b will bear against convex outer surface 38 on hinge portion 14a. Similarly, convex outer surface 108 on hinge portion 14c will bear against concave inner surface 54 on hinge portion 14a and concave inner surface 100 on hinge portion 14c will bear against convex outer surface 38.

The engagement of these convex and concave surfaces with one another will prevent document support 16 from moving relative to sled member 12 in directions transverse to pivot axis P. Furthermore, in the assembled position shown in FIGS. 1 and 2, the end 34 of channel 32 will engage the locating surface 86 projecting from concave inner surface 84, preventing document support 16 from moving relative to sled member 12 in one direction along pivot axis P, and side edge 46 of finger 40 will engage the locating surface 96 projecting from convex outer surface 92, preventing the movement of document support 16 relative to sled member 12 in the opposite direction along pivot axis P. Similarly, the engagement of end 36 of channel 32 with the locating surface 104 projecting from concave inner surface 100 will prevent the movement of document support 16 relative to sled member 12 in one direction along pivot axis P, and the engagement of side edge 52 of finger 42 with the locating surface 112 projecting from convex outer surface 108 will prevent the movement of document support 16 relative to sled member 12 in the opposite direction along pivot axis P.

Other arrangements may be devised to prevent the movement of document support 16 along pivot axis P relative to sled member 12. For example, in the absence of the interengagement of the side edges and locating surfaces discussed above, the relative axial movement may be prevented by sizing notch 56 so that the locating surface 112 and side edge 116 of hinge portion 14c engage the opposed sides of notch 56 in the assembled position. Alternatively, or in addition thereto, notch 58 may be sized so that, in the assembled position, the locating surface 96 and side edge 118 of hinge portion 14b engage the opposed sides of notch 58. In another example, a rib may be formed in the arcuate direction on one of the convex or concave surfaces of hinge portion 14a, and a groove may be formed in the arcuate direction in the corresponding convex or concave surface of hinge portion 14b or 14c, whereby the engagement of the rib in the groove in the assembled position of sled member 12 and document support 16 will prevent these components from moving relative to one another along pivot axis P. Still other arrangements too numerous to describe herein may be employed to prevent the movement of sled member 12 and document support 16 relative to one another along pivot axis P. It is contemplated that such arrangements may be used herein provided they do not interfere with the interengaging convex and concave surfaces of hinge assembly 14.

Hinge assembly 14 is preferably devised so that hinge portions 14a, 14b and 14c may be formed integrally with sled member 12 and document support 16, respectively, such as by an injection molding process. Thus, convex outer surface 38 and concave inner surfaces 48 and 54 of hinge portion 14a, concave inner surface 84 and convex outer surface 92 of hinge portion 14b and concave inner surface 100 and convex outer surface 108 of hinge portion 14c all preferably define an arc of about 180 degrees so that the sled member 12 and document support 16 can be injection molded without the need for removable mold inserts (i.e., without any undercuts so that the sled member 12 and document support 16 can be drawn straight out of the mold), while at the same time maximizing the area of surface contact between hinge portion 14a and hinge portions 14b and 14c in the assembled position.

It will be appreciated that in a variant hereof, hinge assembly 14 may be formed with a hinge portion 14a having a single convex outer surface 38, a single concave inner surface 48 and a single notch 56 all located centrally along the edge 28 of sled member 12, and a hinge portion 14b having a single convex outer surface 92 and a single concave inner surface 84 with a free end 90 all located centrally along the edge 82 of document support 16. In such embodiment, hinge portions 14a and 14b could have a length in the axial direction which encompasses a major portion of the width of sled member 12 and document support 16 so as to minimize the torsional forces on the hinge portions and provide a secure assembly between the components.

Figure 10:
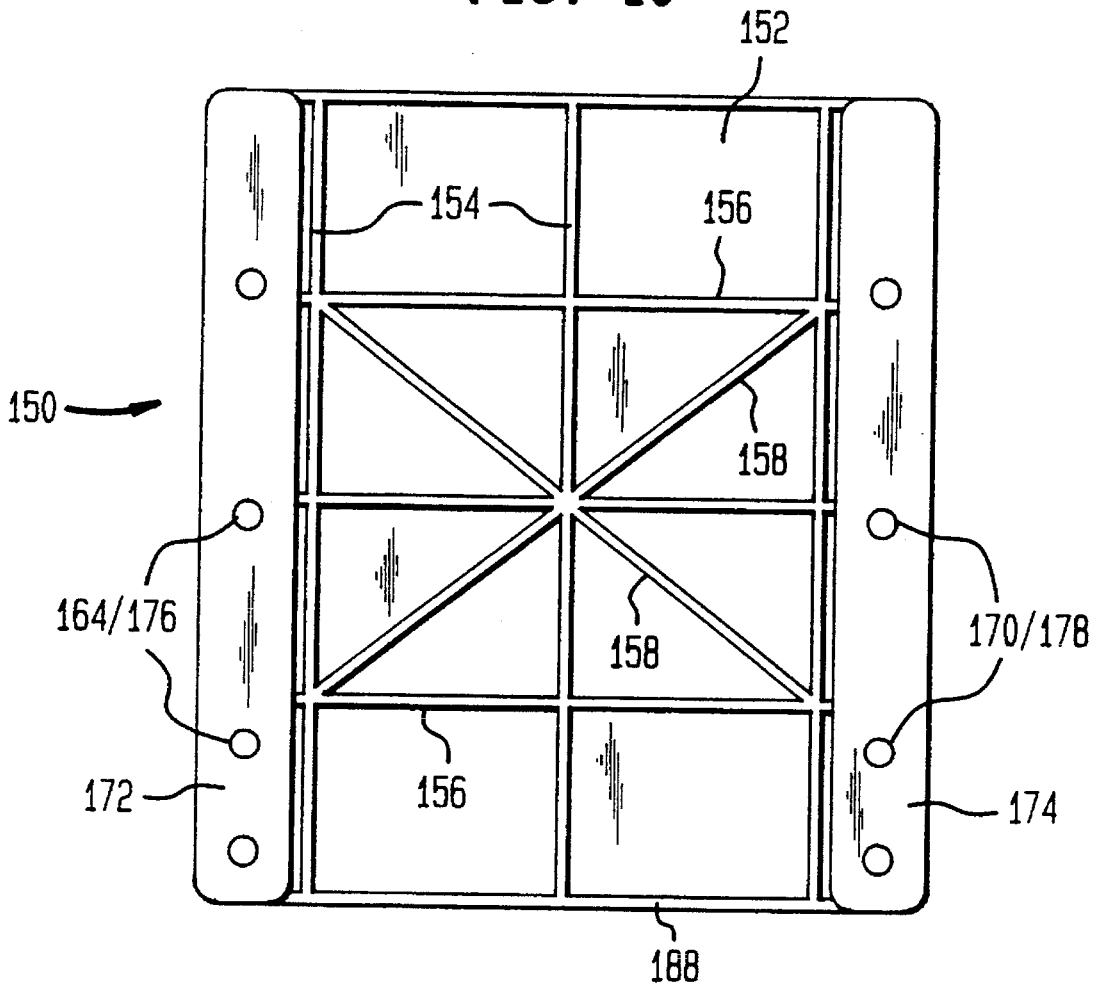
FIG. 10 is a top plan view of a mounting assembly for mounting the document holder shown in FIG. 1.
Figure 11:
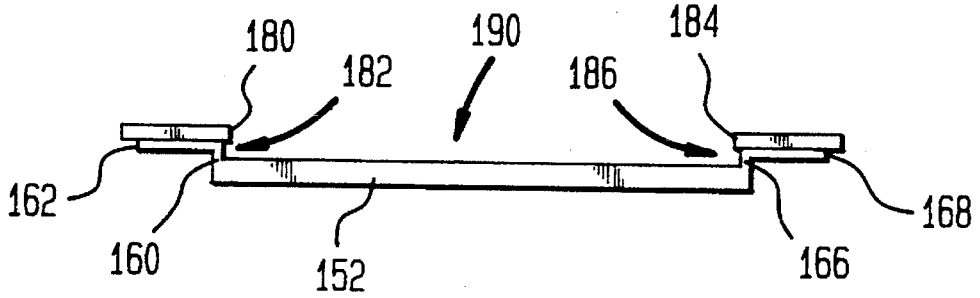
FIG. 11 is a front elevational view of the mounting assembly shown in FIG. 10.

In accordance with one embodiment of the present invention, document holder 10 may be slideably mounted to the underside of a work surface by a base assembly 150 shown in FIGS. 10 and 11. Base assembly 150 is intended to be used where document holder 10 is to be mounted to the underside of the work surface independently of other devices, such as keyboard support assemblies. Referring to FIGS. 10 and 11, base assembly 150 includes a generally flat panel 152 having longitudinal reinforcing ribs 154, transverse reinforcing ribs 156 and diagonal reinforcing ribs 158 formed on the upper surface thereof. A side wall 160 projects upwardly from one longitudinal edge of panel 152 and includes a flange 162 extending the length of panel 152 in a plane parallel thereto. A plurality of apertures 164 may be formed at spaced distances along the length of flange 162. The opposite longitudinal edge of panel 152 includes a similar side wall 166 and a flange 168 having a plurality of spaced apertures 170 formed along its length.

Base assembly 150 may further include a pair of flat keepers 172 and 174 having apertures 176 and 178 formed at spaced intervals along their respective lengths. Keepers 172 and 174 may be positioned on flanges 162 and 168, respectively, so that the apertures 176 in keeper 172 are aligned with the apertures 164 in flange 162, and the apertures 178 in keeper 174 are aligned with the apertures 170 in flange 168. With the apertures aligned as described, the inside edge 180 of keeper 172 extends beyond side wall 160 so as to define a narrow channel 182 along one longitudinal edge of panel 152. In like fashion, with keeper 174 properly positioned, the inside edge 184 thereof extends beyond side wall 166 so as to define a narrow channel 186 along the opposite longitudinal edge of panel 152.

In mounting base assembly 150 to the underside of a work surface, such as a desk or work station, the base assembly is positioned such that the raised front lip 188 thereof lies adjacent to and parallel with the front edge of the work station. Keeper 174 is then positioned between flange 162 and the underside of the work station such that its apertures 176 are aligned with apertures 164 in flange 162, and keeper 176 is positioned between flange 168 and the underside of the work station such that its apertures 178 are aligned with apertures 170 in flange 168. Mounting screws (not shown) may then be inserted upwardly through aligned apertures 164 and 176 on one side of base assembly 150 and through aligned apertures 170 and 178 on the other side of base assembly 150 for mounting the base assembly to the underside of the work station.

With base assembly 150 mounted to the work surface as described above, panel 152 will be positioned at a spaced distance from the underside of the work station so as to define a slot 190 for slideably receiving document holder 10. As document holder 10 is inserted into slot 190 in the collapsed condition shown in FIG. 2, the lip 20 along the longitudinal side edges 22 and 24 of sled member 12 will be positioned within channels 182 and 186, respectively. The bottom surface of the inner edge 180 of keeper 172 thus provides a smooth guiding surface for the upper edge of the lip 20 formed along the longitudinal side edge 22 of sled member 12. Similarly, the bottom surface of the inner edge 184 of keeper 174 provides a smooth surface for guiding the upper edge of lip 20 along the longitudinal side edge 24 of sled member 12. Document holder 10 may be slid into slot 190 until it reaches the fully retracted position in which the outside surfaces of fingers 40 and 42 contact the front lip 188 of base assembly 150.

To place document holder 10 in a use position from the fully retracted position, the front edge of the document holder is raised slightly by lifting upwardly on hinge assembly 14 so that the free edges 29 of bosses 27 are positioned above the top surfaces of transverse reinforcing ribs 156 and front lip 188 of base assembly 150. Document holder 10 may then be freely slid out from underneath the work surface to a fully extended position in which the lateral rear edge 66 of document support 16 has cleared the front edge of the work station. Since sled member 12 is longer in length than document support 16, the raised lip 20 along the longitudinal side edges 22 and 24 of sled member 12 will still be held in place within narrow channels 182 and 186 in base assembly 150. In this fully extended position, document support 16 may be pivoted upwardly away from sled member 12 and arms 68 and 70 may be pivoted outwardly to the position shown in FIG. 1. Sled member 12 may then be slid back into slot 190 in base assembly 150 until the back surface of raised document support 16 contacts and is supported by the front edge of the work surface. The front edge of document holder 10 may be lowered as sled member 12 is slid inwardly since the tapered free edges 29 of bosses 27 permit the sled member to slide smoothly over the raised front lip 188 and transverse reinforcing ribs 156 of base assembly 150 in the inward direction. Sliding sled member 12 either inwardly or outwardly with respect to base assembly 150 adjusts the angle at which the front edge of the work surface will hold the document support 16. When the desired angle has been reached, one of the free edges 29 of bosses 27 will be engaged with the front lip 188 of base assembly 150 to lock document holder 10 in place.

To return document holder 10 to the fully retracted position shown in FIG. 1, the document holder is first brought to the fully extended position by lifting upwardly on the front edge of the document holder and then pulling sled member 12 outwardly until the lateral rear edge 66 of document support 16 has cleared the front edge of the work station. Arms 68 and 70 may then be rotated behind panel 60 and document support 16 pivoted downwardly until it rests upon sled member 12. The entire document holder 10 may then be slid inwardly below the work surface until the fully retracted position is reached.

Document holder 10 can serve many uses not only in the use position shown in FIG. 1, but also in the fully retracted position shown in FIG. 2. For example, in the fully retracted or use positions, the channel 32 of hinge assembly 14 can be used to store pens, pencils or other writing implements. Also, sled member 12 can be used as a draw for storing thin articles, such as papers, cards, floppy disks, etc. In the use position, document holder 10 can support one or more documents by resting the documents against document support 16 with the bottom edge of the documents positioned and supported within channel 32. Also, where document holder 10 is not supporting pages, the front surfaces of document support 16 and arms 68 and 70 can display pre-printed messages as indicated at 77, 79 and 81 in FIG. 1, such as use instructions, advertisements, safety or warning statements, a guide to software prompts, telephone lists, corporate policy statements, general information, etc. In addition to the foregoing, document support 16 can be removed from sled member 12 and replaced with a device for performing a different function. In one embodiment, for example, document support 16 may be replaced with a flat panel, the front surface of which is coated with a waterless marker surface, enabling document holder 10 to be used as an erasable note pad/message board. In other embodiments, document support 16 may be removed and replaced with a flat panel incorporating a calculator, with a map of a sales or distribution territory, with a steel panel for holding magnetic markers in place and the like.

Figure 12:
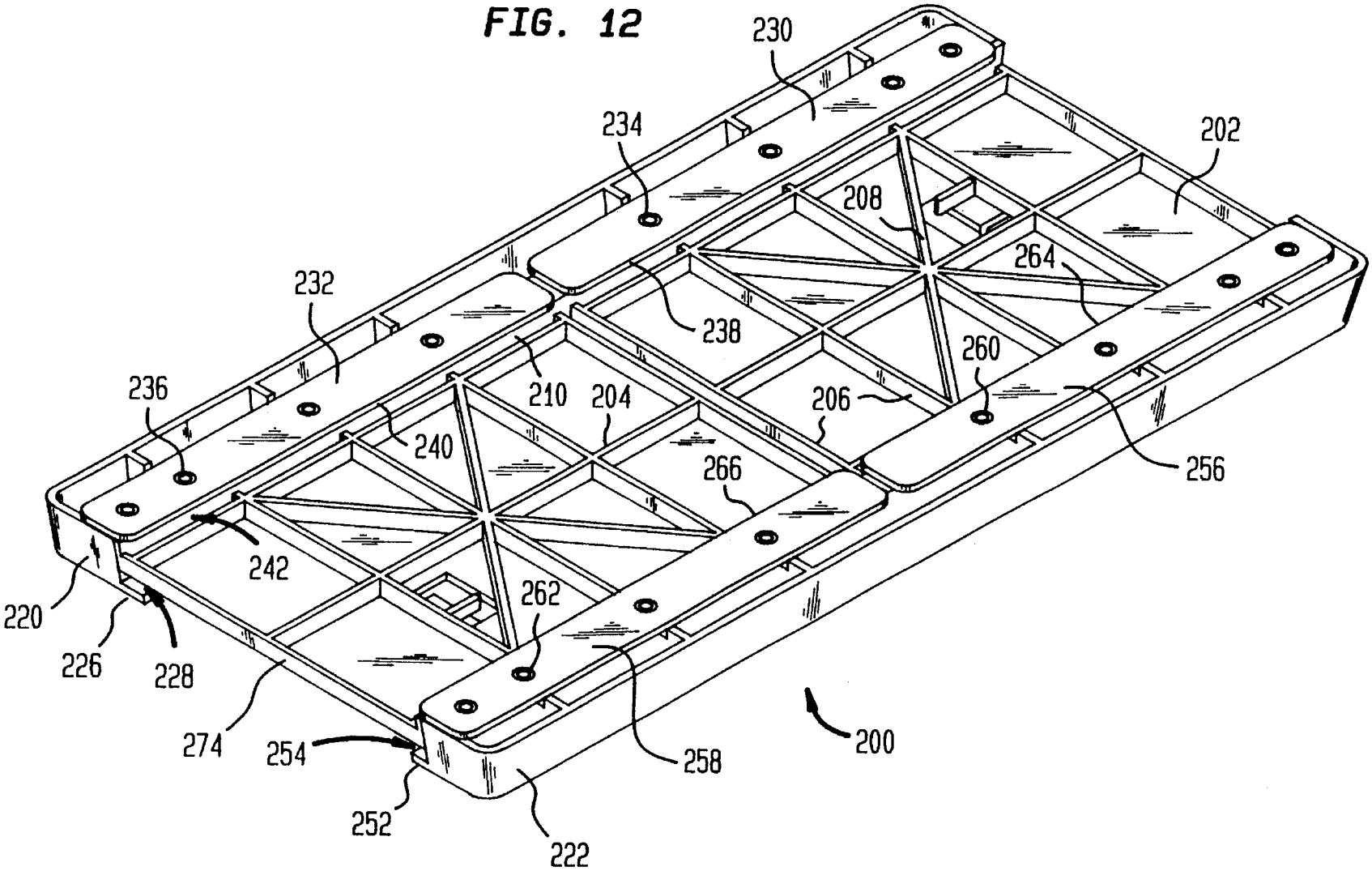
FIG. 12 is a perspective view of an alternate embodiment of a mounting assembly for mounting the document holder shown in FIG. 1.
Figure 13:
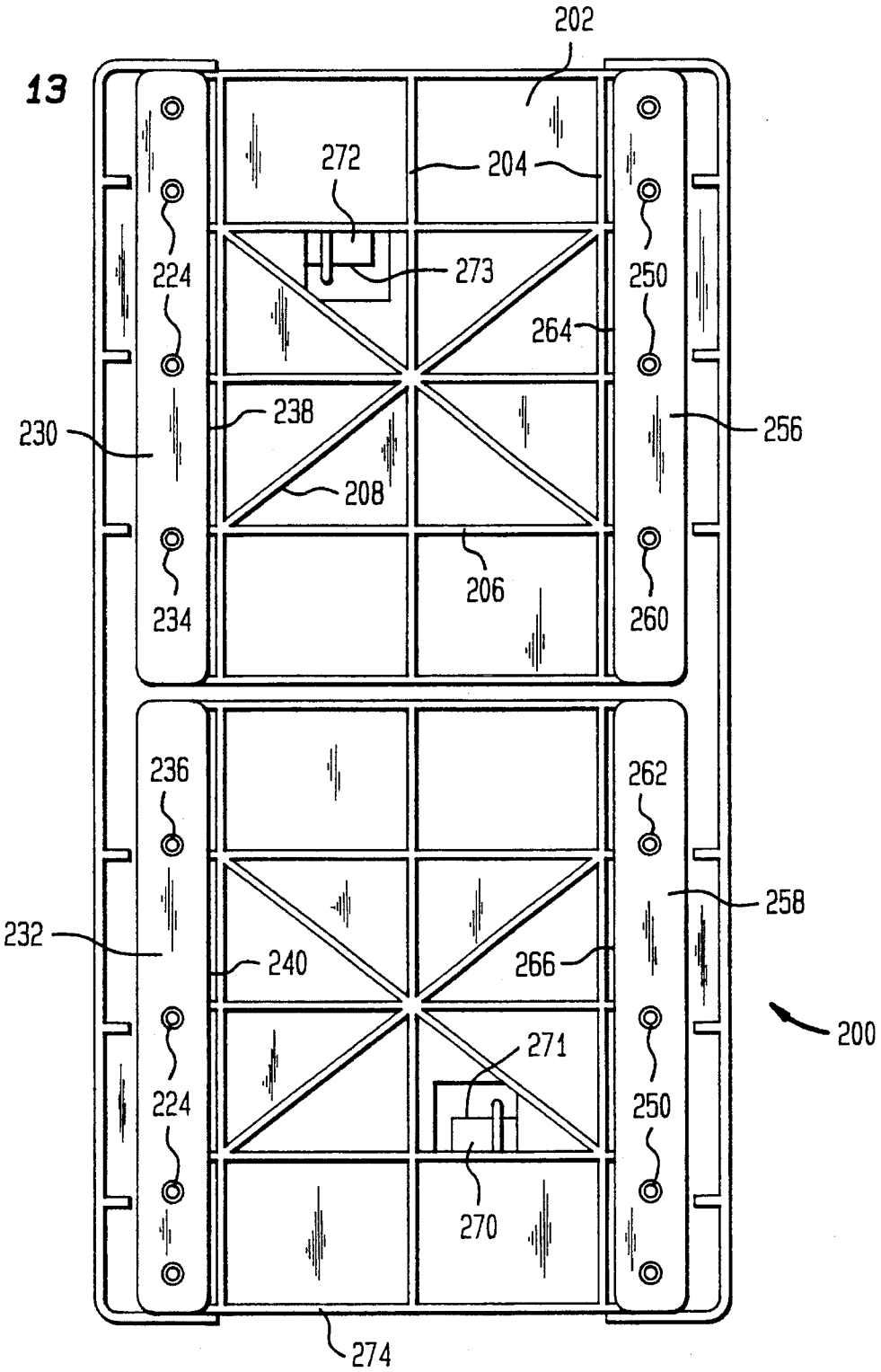
FIG. 13 is a top plan view of the mounting assembly shown in FIG. 12.
Figure 14:
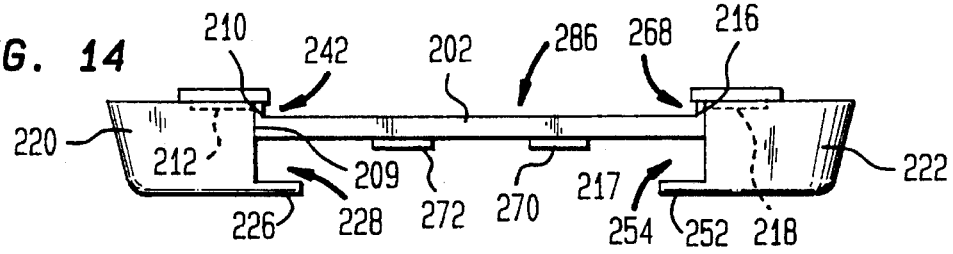
FIG. 14 is a front elevational view of the mounting assembly shown in FIG. 12.

In another embodiment of the present invention, document holder 10 may be slideably mounted to the underside of a work surface by a base assembly which simultaneously mounts a keyboard support assembly to the underside of the work surface. One such base assembly 200 is shown in FIG. 12–14. Base assembly 200 is similar in construction to base assembly 150, but generally about twice the length. Thus, base assembly 200 includes a generally flat panel 202, the upper surface of which is formed with longitudinal reinforcing ribs 204, transverse reinforcing ribs 206 and diagonal reinforcing ribs 208. One longitudinal edge 209 of panel 202 includes a side wall 210 with a flange 212 projecting outwardly therefrom. A plurality of apertures (not shown) may be formed at spaced distances along the length of flange 212. A similar side wall 216 may be formed on the opposite longitudinal edge 217 of panel 212. Side wall 216 includes a flange 218 having a plurality of spaced apertures (not shown) formed along its length.

Base assembly 200 further includes a pair of side members 220 and 222. Side member 220 includes a series of spaced upwardly projecting hollow bosses 224 having outer diameters sized for force-fit engagement in the apertures in flange 212 to assemble side member 220 to flange 212. The inner diameters of bosses 224 include a shoulder (not shown) for supporting the head of a screw used to mount base assembly 200 to a work surface. Side member 220 also includes a lip 226 which extends the length of base assembly 200 at a spaced distance from flat panel 202 to thereby define a channel 228 beneath longitudinal edge 209 of panel 202. A pair of keepers 230 and 232 include apertures 234 and 236 formed at spaced intervals along their respective lengths and sized for assembling the keepers in force-fit engagement onto bosses 224. In their assembled position, inside edge 238 of keeper 230 and inside edge 240 of keeper 232 together define a continuous narrow channel 242 above the longitudinal edge 209 of panel 202.

Side member 222 is similar in construction to side member 220. Thus, side member 222 includes a series of spaced upwardly projecting hollow bosses 250 having outer diameters sized for force-fit engagement in the apertures in flange 218 to assemble side member 222 to flange 218, and inner diameters including a shoulder (not shown) for supporting the head of a screw mounting base assembly 200 to a work surface. In addition, a lip 252 on side member 222 extends the length of base assembly 200 at a spaced distance from flat panel 202 to thereby define a channel 254 beneath longitudinal edge 217 of panel 202. A pair of keepers 256 and 258 include spaced apertures formed along their respective lengths and sized to assemble the keepers in force-fit engagement to bosses 250. In this assembled position, inside edge 264 of keeper 256 and inside edge 266 of keeper 258 together define a continuous narrow channel 268 above the longitudinal edge 217 of panel 202.

Figure 15:
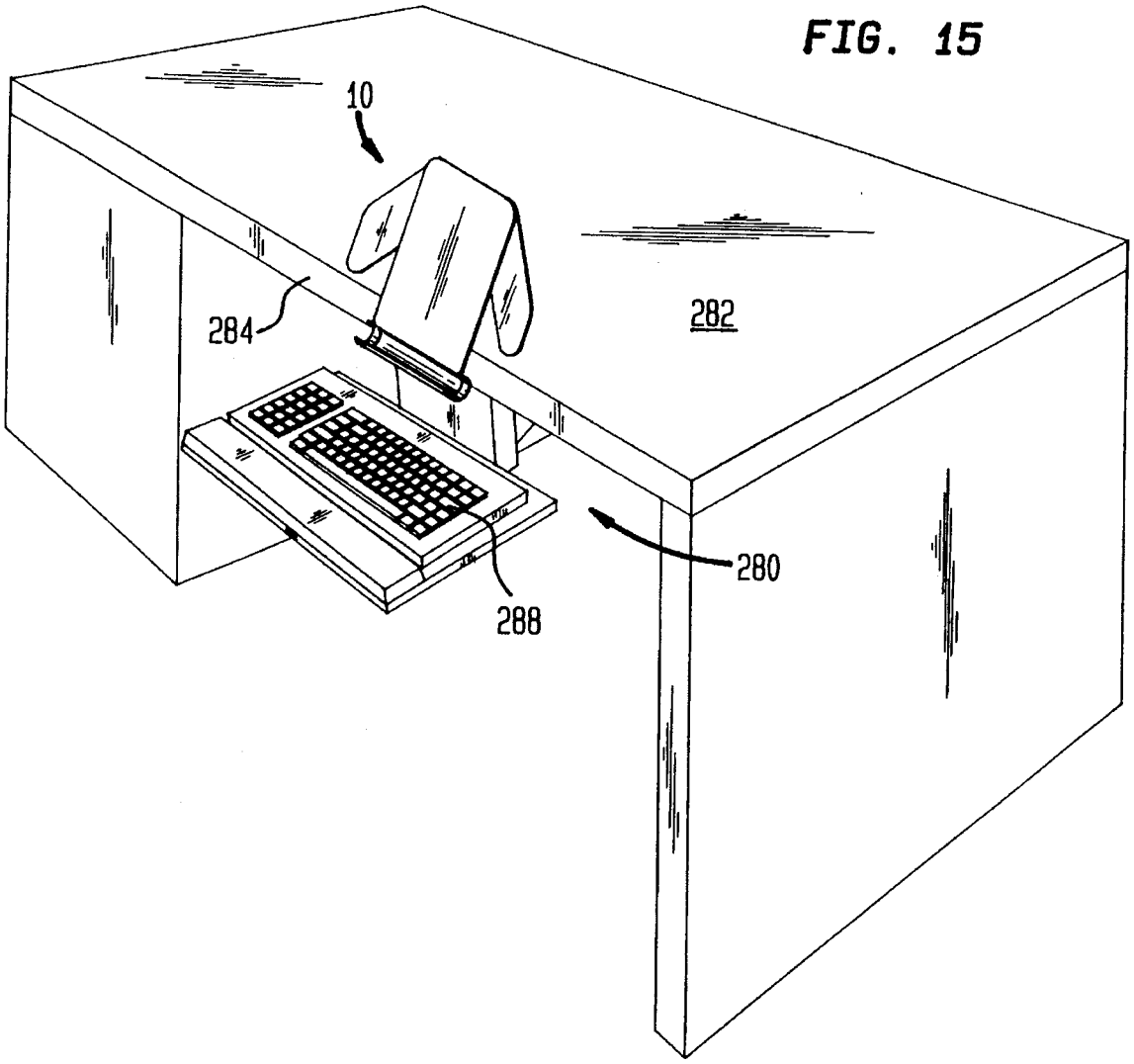
FIG. 15 is a perspective view showing the document holder of FIG. 1 connected to a work station and deployed in the use position.

In addition to the foregoing, base assembly 200 includes forward locking tab 270 and rear locking tab 272 which taper downwardly from their points of attachment to panel 202 to their respective free ends 271 and 273 located below the bottom surface of panel 202. As will be described hereinbelow, locking tabs 270 and 272 define the forward and rearward limits of travel for a keyboard support assembly, indicated generally at 280 in FIG. 15.

Base assembly 200 may be mounted to the underside of a work surface 282 by positioning the raised front lip 274 thereof adjacent to and parallel with the front edge 284 of the work surface. A plurality of mounting screws (not shown) may then be inserted upwardly through hollow bosses 224 and 250 on the opposite sides of base assembly 200 for connecting the base assembly to the underside of work surface 282. In this mounted position, panel 202 will be spaced from the underside of work surface 282 so as to define a slot 286 for slideably receiving document holder 10.

Document holder 10 may be assembled in slot 286 and moved between the fully retracted position and a use position in the same manner as described above in connection with the movement of document holder 10 in base assembly 150. Keyboard support assembly 280 may be slideably assembled to base assembly 200 by inserting a generally flat mounting plate (not shown) of the keyboard support assembly within channels 228 and 254. Keyboard support assembly 280 may move within channels 228 and 254 between a fully retracted position in which the rear edge of the mounting plate contacts the free edge 273 of locking tab 272 and in which the supported keyboard 288 is positioned substantially below work surface 282, and the fully extended position in which the front edge of the mounting plate contacts the free end 271 of locking tab 270 and in which the supported keyboard 288 protrudes substantially entirely from below work surface 282. Document holder 10 may be moved between the fully retracted position and use positions entirely independently of the movement or position of keyboard support assembly 280.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

I claim:

1. A hinge assembly for removably connecting a first unit to a second unit in an assembled position for pivotable movement about a pivot axis extending in an axial direction, comprising a first hinge element on said first unit, said first hinge element including a first convex arcuate surface having a first radius of curvature and a first concave arcuate surface having a second radius of curvature and a free end, a second hinge element on said second unit, said second hinge element including a second convex arcuate surface having a radius of curvature substantially equal to said second radius of curvature, and a second concave arcuate surface having a radius of curvature substantially equal to said first radius of curvature, wherein in said assembled position of said first and second units, said first convex arcuate surface matingly engages said second concave arcuate surface and said first concave arcuate surface matingly engages said second convex arcuate surface to prevent movement of said first unit relative to said second unit in a direction transverse to said axial direction, and locating means for preventing movement of said first unit relative to said second unit in said axial direction.

2. The hinge assembly as claimed in claim 1, wherein said locating means includes a first locating surface positioned on said first hinge element radially outward of said first convex arcuate surface, a second locating surface positioned on said first hinge element radially inward of said first concave arcuate surface, a third locating surface positioned on said second hinge element radially outward of said second convex arcuate surface, and a fourth locating surface positioned on said second hinge element radially inward of said second concave arcuate surface, wherein in said assembled position of said first and second units, said first locating surface engages said third locating surface and said second locating surface engages said fourth locating surface to prevent movement of said first unit relative to said second unit in said axial direction.

3. The hinge assembly as claimed in claim 1, wherein said locating means includes first and second locating surfaces positioned on said first hinge element radially outward of said first convex arcuate surface and third and fourth locating surfaces positioned on said second hinge element radially outward of said second convex arcuate surface, wherein in said assembled position of said first and second units, said first locating surface engages said third locating surface and said second locating surface engages said fourth locating surface to prevent movement of said first unit relative to said second unit in said axial direction.

4. The hinge assembly as claimed in claim 1, wherein said first and second hinge elements in said assembled position define a hollow channel extending in said axial direction.

5. The hinge assembly as claimed in claim 4, wherein said first unit is pivotably movable relative to said second unit between a collapsed condition in which said first unit is adjacent said second unit and a use position in which said first unit is remote from said second unit, said hollow channel in said collapsed condition defining a semicircular trough.

6. The hinge assembly as claimed in claim 1, wherein said second radius of curvature is substantially equal to said first radius of curvature.

7. The hinge assembly as claimed in claim 1, wherein each one of said arcuate surfaces defines an arc of about 180 degrees.

8. The hinge assembly as claimed in claim 7, wherein said first convex arcuate surface is spaced in said axial direction from said first concave arcuate surface and said second convex arcuate surface is spaced in said axial direction from said second concave arcuate surface.

9. The hinge assembly as claimed in claim 7, wherein said first convex arcuate surface is positioned on one side of said pivot axis and said first concave arcuate surface is positioned on said one side of said pivot axis.

10. The hinge assembly as claimed in claim 1, wherein said first convex arcuate surface is spaced in said axial direction from said first concave arcuate surface and said second convex arcuate surface is spaced in said axial direction from said second concave arcuate surface.

11. A hinge assembly for removably connecting a first unit to a second unit in an assembled position for pivotable movement about a pivot axis extending in an axial direction, comprising a first pair of hinge elements on said first unit and separated by a spaced distance in said axial direction, one of said first pair of hinge elements including a first convex arcuate surface having a first radius of curvature and a first concave arcuate surface having a second radius of curvature and a free end, another one of said first pair of hinge elements including a second convex arcuate surface having a third radius of curvature and a second concave arcuate surface having a fourth radius of curvature and a free end, a second pair of hinge elements on said second unit and separated by said spaced distance in said axial direction, one of said second pair of hinge elements including a third convex arcuate surface having a radius of curvature substantially equal to said second radius of curvature and a third concave arcuate surface having a radius of curvature substantially equal to said first radius of curvature, another one of said second pair of hinge elements including a fourth convex arcuate surface having a radius of curvature substantially equal to said fourth radius of curvature and a fourth concave arcuate surface having a radius of curvature substantially equal to said third radius of curvature, wherein in said assembled position of said first and second units, said first convex arcuate surface matingly engages said third concave arcuate surface, said second convex arcuate surface matingly engages said fourth concave arcuate surface, said first concave arcuate surface matingly engages said third convex arcuate surface, and said second concave arcuate surface matingly engages said fourth convex arcuate surface to prevent movement of said first unit relative to said second unit in a direction transverse to said axial direction, and locating means for preventing movement of said first unit relative to said second unit in said axial direction.

12. The hinge assembly as claimed in claim 11, wherein said locating means includes a first locating surface positioned on said one of said first pair of hinge elements radially outward of said first convex arcuate surface, a second locating surface positioned on said one of said first pair of hinge elements radially inward of said first concave arcuate surface, a third locating surface positioned on said one of said second pair of hinge elements radially outward of said third convex arcuate surface, and a fourth locating surface positioned on said one of said second pair of hinge elements radially inward of said third concave arcuate surface, wherein in said assembled position of said first and second units, said first locating surface engages said third locating surface and said second locating surface engages said fourth locating surface to prevent movement of said first unit relative to said second unit in said axial direction.

13. The hinge assembly as claimed in claim 11, wherein said locating means includes first and second locating surfaces positioned on said one of said first pair of hinge elements radially outward of said first convex arcuate surface and third and fourth locating surfaces positioned on said one of said second pair of hinge elements radially outward of said second convex arcuate surface, wherein in said assembled position of said first and second units, said first locating surface engages said third locating surface and said second locating surface engages said fourth locating surface to prevent movement of said first unit relative to said second unit in said axial direction.

14. The hinge assembly as claimed in claim 13, wherein said first unit is pivotably movable relative to said second unit between a collapsed condition in which said first unit is adjacent said second unit and a use position in which said first unit is remote from said second unit, said hollow channel in said collapsed condition defining a semicircular trough.

15. The hinge assembly as claimed in claim 11, wherein said first and second pairs of hinge elements in said assembled position define a hollow channel extending in said axial direction.

16. The hinge assembly as claimed in claim 11, wherein said second radius of curvature is substantially equal to said first radius of curvature.

17. The hinge assembly as claimed in claim 16, wherein said third and fourth radii of curvature are substantially equal to said first radius of curvature.

18. The hinge assembly as claimed in claim 11, wherein each one of said arcuate surfaces defines an arc of about 180 degrees.

19. The hinge assembly as claimed in claim 18, wherein said first convex arcuate surface is positioned on one side of said pivot axis and said first concave arcuate surface is positioned on said one side of said pivot axis.

20. The hinge assembly as claimed in claim 11, wherein said first convex arcuate surface is spaced in said axial direction from said first concave arcuate surface and said second convex arcuate surface is spaced in said axial direction from said second concave arcuate surface.

21. A retractable work apparatus adapted to be mounted to the underside of a work surface, comprising:

a base member;

means for connecting said base member to the underside of the work surface;

a sled member connected to said base member for movement between a retracted position in which said sled member lies substantially below the work surface and an extended position in which said sled member protrudes substantially from below the work surface;

a work unit removably connectable to said sled member in an assembled position; and hinge means for removably connecting said work unit to said sled member for pivotable movement about a pivot axis extending in an axial direction, said hinge means including a first hinge element on said work unit and a second hinge element on said sled member, said first hinge element including a first convex arcuate surface having a first radius of curvature and a first concave arcuate surface having a second radius of curvature and a free end, said second hinge element including a second convex arcuate surface having a radius of curvature substantially equal to said second radius of curvature and a second concave arcuate surface having a radius of curvature substantially equal to said first radius of curvature, wherein in said assembled position of said work unit and said sled member, said first convex arcuate surface matingly engages said second concave arcuate surface and said first concave arcuate surface matingly engages said second convex arcuate surface to prevent movement of said work unit relative to said sled member in a direction transverse to said axial direction, and locating means for preventing movement of said work unit relative to said sled member in said axial direction.

22. The work apparatus as claimed in claim 21, wherein said locating means includes a first locating surface positioned on said first hinge element radially outward of said first convex arcuate surface, a second locating surface positioned on said first hinge element radially inward of said first concave arcuate surface, a third locating surface positioned on said second hinge element radially outward of said second convex arcuate surface, and a fourth locating surface positioned on said second hinge element radially inward of said second concave arcuate surface, wherein in said assembled position of said work unit and said sled member, said first locating surface engages said third locating surface and said second locating surface engages said fourth locating surface to prevent movement of said work unit relative to said sled member in said axial direction.

23. The work apparatus as claimed in claim 21, wherein said locating means includes first and second locating surfaces positioned on said first hinge element radially outward of said first convex arcuate surface and third and fourth locating surfaces positioned on said second hinge element radially outward of said second convex arcuate surface, wherein in said assembled position of said work unit and said sled member, said first locating surface engages said third locating surface and said second locating surface engages said fourth locating surface to prevent movement of said work unit relative to said sled member in said axial direction.

24. The work apparatus as claimed in claim 21, wherein said first and second hinge elements in said assembled position define a hollow channel extending in said axial direction.

25. The work apparatus as claimed in claim 24, wherein said work unit is pivotably movable relative to said sled member between a collapsed condition in which said work unit is adjacent said sled member and a use position in which said work unit is remote from said sled member, said hollow channel in said collapsed condition defining a semicircular trough.

26. The work apparatus as claimed in claim 21, wherein said second radius of curvature is substantially equal to said first radius of curvature.

27. The work apparatus as claimed in claim 21, wherein each one of said arcuate surfaces defines an are of about 180 degrees.

28. The work apparatus as claimed in claim 21, wherein said work unit comprises a panel having a pair of longitudinal side edges extending in a direction transverse to said axial direction, and at least one arm pivotably connected to said panel for movement between a storage position in which said arm resides between said side edges and a use position in which said arm projects outwardly from one of said side edges.

29. The work apparatus as claimed in claim 21, wherein said work unit comprises a panel having a generally flat front surface facing away from said sled member, said front surface including a waterless marker surface.

30. The work apparatus as claimed in claim 21, wherein said work unit comprises a panel having a front surface printed with messages.

31. A work apparatus as claimed in claim 21, wherein said base member includes a pair of spaced support surfaces, said sled member being slideably assembled to said base member for movement on said pair of spaced support surfaces between said retracted and extended positions.

32. The work apparatus as claimed in claim 31, wherein said base member includes another pair of spaced support surfaces, said work apparatus further comprising a keyboard support tray slideably mounted to said base member for movement on said another pair of spaced support surfaces between a retracted position in which said keyboard support tray lies substantially below the work surface and an extended position in which said keyboard support tray extends substantially from below the work surface.

33. The work apparatus as claimed in claim 21, further comprising positioning means on said sled member for releasably locking said sled member in one of a number of preselected positions relative to said base member.

34. A retractable keyboard support assembly adapted to be mounted to the underside of a work surface, comprising:

a base member;

means for connecting said base member to the underside of the work surface;

a keyboard support apparatus connected to said base member for movement between a retracted position in which said keyboard support apparatus lies substantially below the work surface and an extended position in which said keyboard support apparatus protrudes substantially from below the work surface;

a sled member connected to said base member for movement between a retracted position in which said sled member lies substantially below the work surface and an extended position in which said sled member protrudes substantially from below the work surface;

a work unit removably connectable to said sled member in an assembled position; and hinge means for removably connecting said work unit to said sled member for pivotable movement about a pivot axis extending in an axial direction, said hinge means including a first hinge element on said work unit and a second hinge element on said sled member, said first hinge element including a first convex arcuate surface having a first radius of curvature and a first concave arcuate surface having a second radius of curvature and a free end, said second hinge element including a second convex arcuate surface having a radius of curvature substantially equal to said second radius of curvature and a second concave arcuate surface having a radius of curvature substantially equal to said first radius of curvature, wherein in said assembled position of said work unit and said sled member, said first convex arcuate surface matingly engages said second concave arcuate surface and said first concave arcuate surface matingly engages said second convex arcuate surface to prevent movement of said work unit relative to said sled member in a direction transverse to said axial direction, and locating means for preventing movement of said work unit relative to said sled member in said axial direction.

* * * * *